United States Patent [19]

Trierweiler

[11] Patent Number: 4,824,285

[45] Date of Patent: Apr. 25, 1989

[54] APPARATUS AND METHOD FOR BEACH RECLAMATION

[76] Inventor: Joseph C. Trierweiler, 2875 Sanatorium Rd., Howell, Mich. 48843

[21] Appl. No.: 85,619

[22] Filed: Aug. 14, 1987

[51] Int. Cl.[4] ..... E02B 3/04

[52] U.S. Cl. ..... 405/17; 405/15; 405/16

[58] Field of Search ..... 405/15, 19, 16, 17, 405/20, 21, 30, 34, 31, 116

[56] References Cited

U.S. PATENT DOCUMENTS

| | | | |
|---|---|---|---|
| 961,222 | 6/1910 | Fahrney | 405/17 |
| 3,218,808 | 11/1965 | Smith et al. | 405/21 |
| 3,344,609 | 10/1967 | Greiser | 405/17 |
| 3,565,491 | 2/1971 | Frazier | 405/15 X |
| 3,750,408 | 8/1973 | Hartog | 405/15 |

FOREIGN PATENT DOCUMENTS

| | | | |
|---|---|---|---|
| 1278953 | 9/1968 | Fed. Rep. of Germany | 405/16 |
| 698186 | 11/1965 | Italy | 405/16 |
| 8005574 | 5/1982 | Netherlands | 405/16 |

*Primary Examiner*—Dennis L. Taylor
*Attorney, Agent, or Firm*—James M. Deimen

[57] ABSTRACT

An apparatus and method for enviornmentally benign beach reclamation comprising the placing of a synthetic gas permeable mat over the area to be reclaimed and covering the mat with a sand or gravel aggregate supplied from a remote source in the form of a slurry. The liquid for the slurry comprises the water from the body of water adjacent to the beach. All heavy equipment for the beach reclamation is placed at a remote location far removed from the lake bottom, beach and upland area to be reclaimed. Only the manually portable materials and apparatus need to be transported to the beach area, thereby virtually eliminating heavy equipment damage to the upland areas adjoining the beach. The apparatus includes slurry mixing equipment and a slurry pump all mounted on a compact trailer towable with a small truck. As a part of the apparatus are small pumps, manually portable to the body of water, and light-weight plastic hoses and plastic pipe.

17 Claims, 3 Drawing Sheets

APPARATUS AND METHOD FOR BEACH RECLAMATION

BACKGROUND OF THE INVENTION

The field of the invention comprises apparatus, methods and materials for the reclamation of beach areas, lake bottoms and uplands, and in particular, environmentally benign apparatus and methods that can meet the approval of both riparian land owners and governmental licensing authorities.

Historically, efficient means of beach reclamation to provide for erosion control or to cover areas of muck and decaying vegetation has required the use of heavy equipment such as bulldozers, front end loaders and dump trucks on the beach area. Even where the use of such heavy equipment on the beach has not been objectionable, the nearby upland has also been significantly damaged by the movement of the heavy equipment down to the beach area and multiple trips by large dump trucks bringing sand, gravel and other supplies to the beach. Natural uplands, in particular, immediately adjacent the beach area, usually are partially covered by stands of natural grasses that provide the first line of defense against erosion. These areas are particularly delicate and easily damaged or completely destroyed by heavy equipment, all-terrain vehicles and even large numbers of persons enjoying the beach. Where the upland area has been developed with lawns and landscaping, the damage caused by heavy vehicles and apparatus can be extensive and very expensive to repair.

Barge mounted sand pumps and pumps permanently mounted adjacent inlets where sand bars constantly form are well known and have been used to create artificial beaches and repair existing beaches by utilizing sand from an adjacent location. In such cases, the sand or sand and gravel is already thoroughly saturated with water and merely pumped from the bottom of the water body through hoses to the new location.

In the construction of artificial lagoons, canals and in beach reclamation, it is sometimes necessary to deter or prevent the growth of green plants and to stabilize the beach area or underwater area. U.S. Pat. No. 2,333,287 discloses a protective lining for canals intended to be impermeable to water seepage and to prevent vegetative growth. The lining and barrier comprises a textile or reticular mat embedded to reinforce layers of asphaltic material.

More recently, methods and materials have been developed to seal lagoons and pits for the storage of hazardous wastes in a manner harmless to underground water supplies. U.S. Pat. No. 4,194,855 discloses such an earthen pit provided with an impermeable polyvinyl cloride sheet placed between layers of finely ground slag. The impermeable barrier is intended to prevent the passage of any liquids or gases into the earth below, and thereby prevent any contamination of underground water supplies.

Similar liners have been developed for cooling water supply lagoons and waste lagoons wherein there is a dual purpose. Firstly, the liner is intended to prevent the seepage and loss of water from the lagoon into the ground and ground water therebelow; and second, the layer or barrier is intended to deter or prevent the growth of aquatic plants. The installation and use of such pond liners as barriers can result in difficult problems with air or gasses produced by organic decomposition below the liner. U.S. Pat No. 4,294,589 discloses a method of removing entrapped air from beneath the pond liner by progressively removing the air and water from beneath the liner as the pond is filled. The method is directed to lagoons that are empty before the liner is to be placed therein. In this method the lagoon is partially filled with water and then the water and air withdrawn from underneath the liner as additional water is pumped on top of the liner.

U.S. Pat. No. 4,577,996 discloses a silicone rubber coated fabric that utilizes a filler to increase the specific gravity of the liner to an excess of 1, thereby destroying the natural buoyancy of the liner. The filler and silicone rubber also acts as a light barrier to discourage the growth of aquatic plants from beneath the barrier. The barrier is somewhat gas permeable to allow gasses produced by organic decomposition beneath the liner to pass through the liner rather than lifting the liner from the bottom of the pond.

U.S. Pat. No. 4,518,280 discloses a slotted plastic film for use as an aquatic weed barrier. The slots are so positioned that flaps are formed in the plastic film to permit gasses to pass through the barrier and thereby reduce the gas pressure from underneath the barrier, which otherwise might cause the barrier to bubble upward. Such a barrier, however, is not suitable where the plastic film is to be covered with sand or gravel which would likely prevent the flaps from properly opening and permitting the gasses from passing therethrough.

Returning to the slurry pumps noted above, U.S. Pat. No. 4,451,180 discloses a railroad car mounted mixing and pumping apparatus intended for connection with a work train having supply cars with sand, fly ash, water and cement. The mixing and pumping apparatus on the rail car is adapted to mix and pump a slurry of the above constituents and supply the slurry under pressure to an injection rack attached to the mixing and pumping rail car. The injection rack in turn is equipped with a plurality of injectors adapted to pass between the railroad ties to inject the slurry mixture therebeneath and, upon the hardening of the slurry, to thereby stabilize the road bed for the track. The mixing and pumping rail car includes a dry pre-mix pug mill supplying a feed auger into a wet pug mill mixer, wherefrom the wet slurry is then forced by a slurry pump to the injectors mounted on the injector rack.

SUMMARY OF THE INVENTION

The method for the environmentally benign beach reclamation comprises the placing of a suitable gas permeable mat on those areas of the beach, upland and underwater areas to be reclaimed and utilizing manually portable small pumps to pump water from the adjacent body of water to a remotely located mixing and pumping apparatus. The mixing and pumping apparatus combines a washed sand, sand and gravel or other aggregate mixture with the water from the local body of water to form a slurry. The slurry is then pumped through manually portable piping and hoses back down to the beach area where the slurry is spread over the gas permeable mat. The clean, washed materials, which, for the purposes of this application, are generally refered to as aggregate, but may be sand or sand and gravel or other aggregate mixtures, is combined only with water already existing in the body of water, thereby substantially lessening or eliminating the addition of any polluting materials to the body of water. The slurry mixing and pumping apparatus, which is all mounted on a small truck trailer, is suitably positioned at a location far removed from the beach and upland, thus completely preventing damage from heavy equipment. The apparatus includes plastic hoses and plastic piping, each piece of which can be easily carried by one person, and portable gasoline engine driven pumps, each of which can be easily wheeled by one person down to the edge of the body of water without significant damage to sensitive upland.

The relatively heavy small trailer containing the mixing and pumping apparatus also includes conveyor means for receiving the aggregate from large double bottom trailer gravel hauling trucks. In normal use, the trailer remains parked on a nearby road, providing good access for the large gravel trucks to supply the slurry mixing and pumping apparatus. The trailer includes racks to hold lengths of plastic pipe and coils of hose.

The mixing hopper on the trailer is supplied directly with two separate inlets for water from the manually portable pumps. The inlets are at two separate levels of the hopper, the lower level being directed across the bottom of the hopper toward the outlet to the slurry pump. The configuration is particularly effective for handling sometimes uneven flows of aggregate into the mixing hopper, thus reducing the possibility of damage and wear to the slurry pump.

DESCRIPTION OF THE PREFERRED EMBODIMENT

Figure 4:
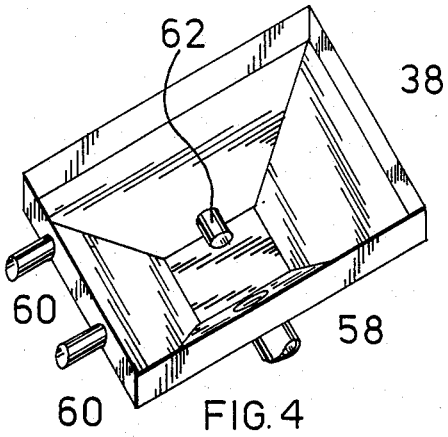
FIG. 4 is a perspective view from above of the mixing hopper mounted on the slurry mixing and pumping trailer taken in the direction of arrow 4 in FIG. 2.
Figure 3:
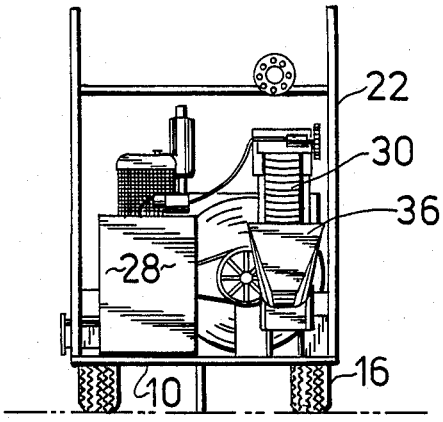
FIG. 3 is a rear end view of the slurry mixing and pumping trailer.

Illustrated in FIGS. 1, 2, 3, 5 and 6, the trailer comprises a low-boy floor 10 having a tongue and a ball hitch 12 at the front with a hand operated jack 14 thereadjacent. On either side of the trailer are a pair of wheels and tires 16 with fenders 18 thereabove. The floor 10 of the trailer is stiffened by a truss 20 on each side of the trailer. Extending from the floor 10 of the trailer upwardly is a pipe rack frame 22. The floor 10, frame truss 20, pipe rack 22 and tongue are preferably of welded steel construction.

Mounted on the trailer is a prime mover such as a diesel engine 24 which is equipped with both a multiple pulley take off drive 26 and a small hydraulic pump mounted to the engine. A four-cylinder, 75-horsepower General Motors Diesel engine is suitable. Also mounted on the trailer is a hydraulic reservoir 28.

Toward the other side of the trailer and extending generally upwardly is an aggregate conveyor 30 which is driven by a small hydraulic motor 32 through a chain and sprockets 34. At the lower end of the conveyor and the back of the trailer is a receiving funnel or hopper 36 to feed aggregate onto the conveyor 30. At the front of the trailer is a mixing hopper 38 so positioned that aggregate coming off the upper end of the conveyor 30 drops directly into the mixing hopper.

Adjacent the mixing hopper 38 and partially underneath the upper end of the conveyor 30 is a slurry pump 40 mounted transverse to the trailer. The slurry pump 40 is of conventional design and, in the preferred embodiment, is equipped with a six inch outlet 42 at the side of the trailer for the attachment of portable pipe, such as the length of six inch plastic pipe 44 resting in the pipe rack 22 at the top of the trailer. The slurry pump 40 is driven by the diesel engine 24 through a plurality of belts 46. The belts 46 extend from the engine pulley 26 to a larger pump pulley 48 mounted on a pump shaft 50 in turn supported in bushing blocks 54. A moveable idler roller 56 rests upon the plurality of belts 46 to tighten or loosen the belt tension and thereby act as a simple clutch between the diesel engine 24 and the pump 40.

Figure 2:
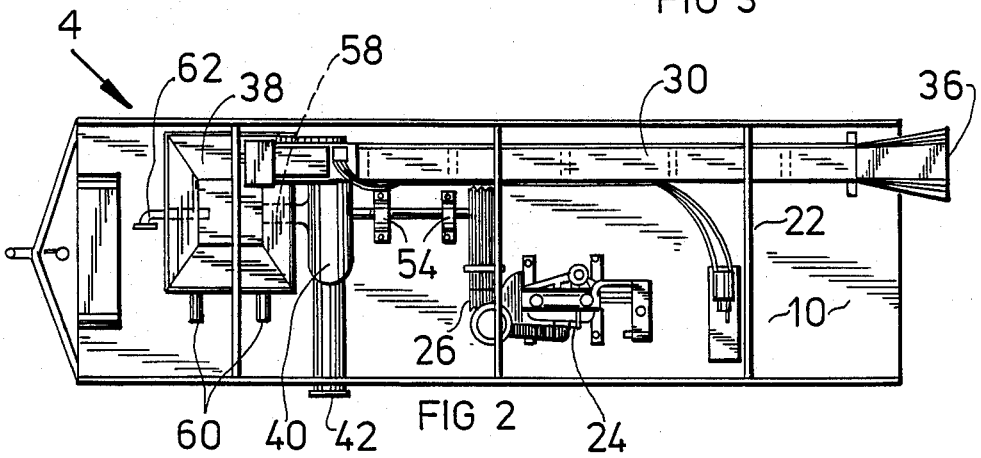
FIG. 2 is a plan view of the slurry mixing and pumping trailer.
Figure 1:
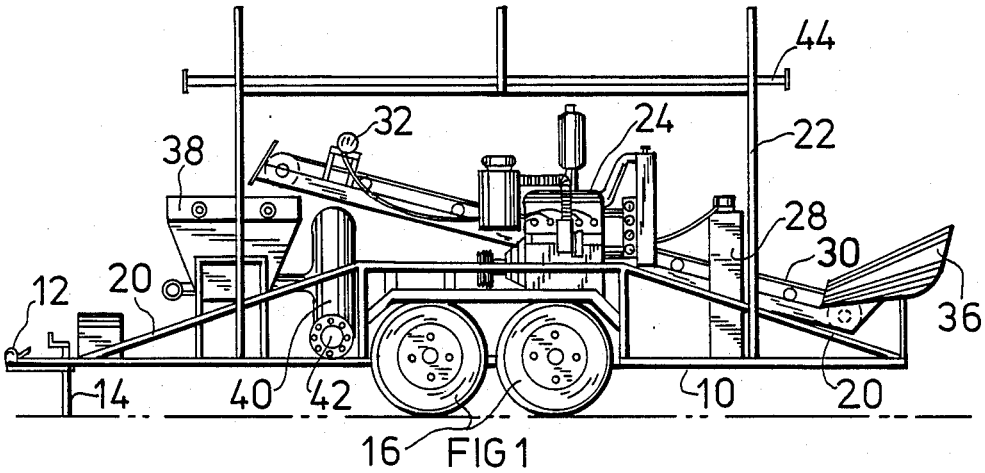
FIG. 1 is a side elevation of the slurry mixing and pumping trailer.

Refering to FIGS. 1, 2 and 4, the slurry pump 40 is supplied with slurry through an inlet pipe 58 which extends into the bottom of the mixing hopper 38 to form an outlet therefrom. The mixing hopper 38 includes one or more upper inlet pipes 60 and a lower inlet pipe 62. The lower inlet pipe 62 is positioned opposite the outlet pipe 58 to direct the stream of water toward the outlet pipe 58. Aggregate entering the mixing hopper 38 from the conveyor 30 is mixed with water streaming in through the inlet pipe 60 and drops downwardly toward the outlet pipe 58. The lower inlet pipe 62 flow of water assures that any slugs of aggregate that are not thoroughly mixed thereabove are forced to pass into the outlet pipe 58 with a large quantity of water from the lower inlet pipe 62, thus assuring that dry slugs of aggregate are not injected into the slurry pump 40.

Figure 10:
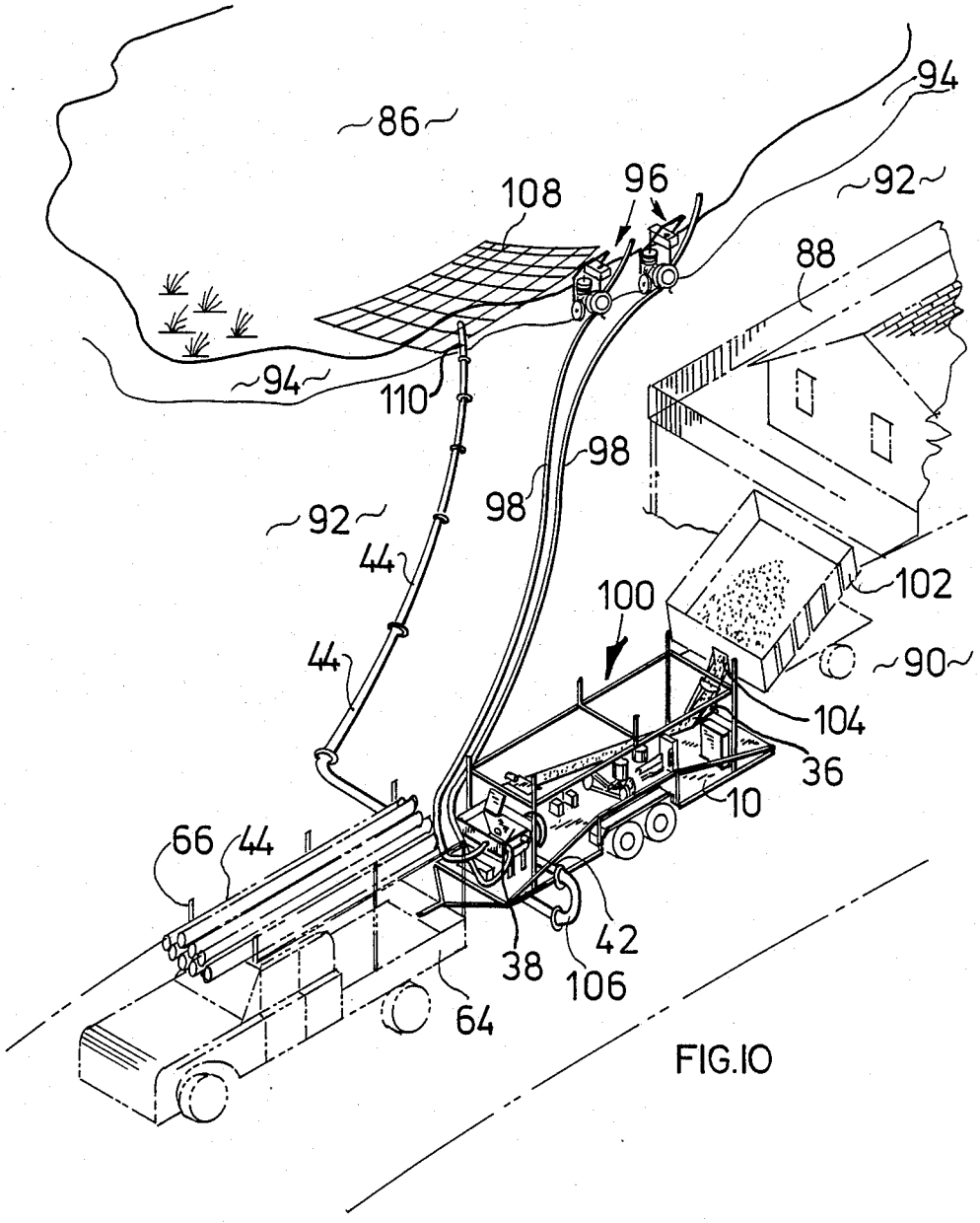
FIG. 10 is a perspective view of a typical installation for beach reclamation.

The entire trailer apparatus provides a compact and efficient unit approximately 8 feet wide and less than 30 feet long. Fully loaded with pipe on the rack, the trailer is easily towable with a 3-quarter ton truck 64 as illustrated in FIG. 10. The truck 64 is shown ghosted and also suitably equipped with a pipe rack 66 carrying plastic pipes 44 thereon.

Figure 8:
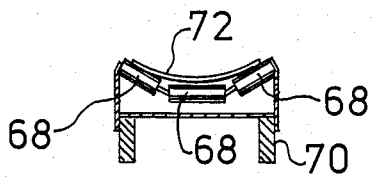
FIG. 8 is a detail perspective of the aggregate conveyor taken along line 8—8 in FIG. 5.

FIG. 8 illustrates in cross section a detail of the aggregate conveyor 30, which simply is equipped with a plurality of triple rollers 68 mounted to a frame 70 and supporting a depressed belt 72 so shaped to keep the aggregate within the confines of the conveyer.

Figure 9:
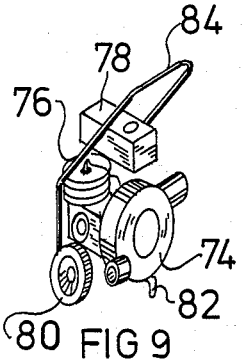
FIG. 9 is a perspective view of a manually portable pump.
Figure 6:
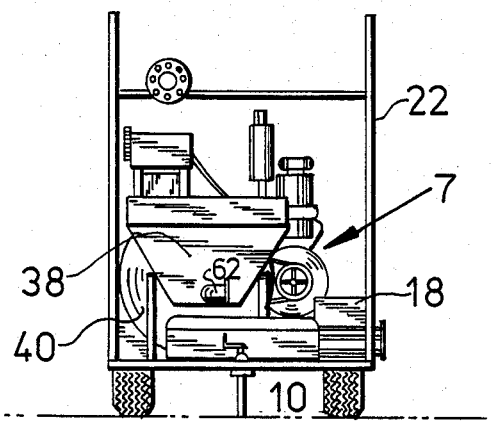
FIG. 6 is a front view of the slurry mixing and pumping trailer.
Figure 7:
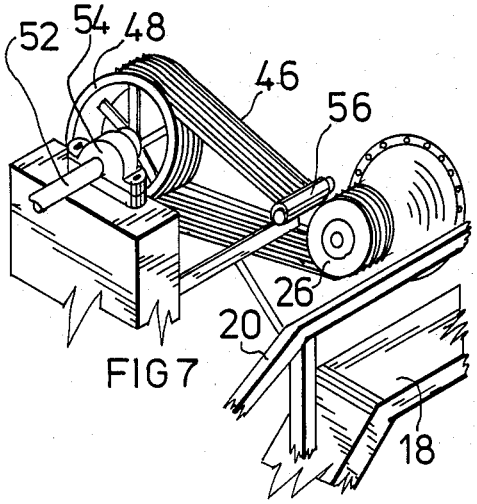
FIG. 7 is a detail perspective of the belt drive to the slurry pump taken in the direction of arrow 7 in FIG. 6.
Figure 5:
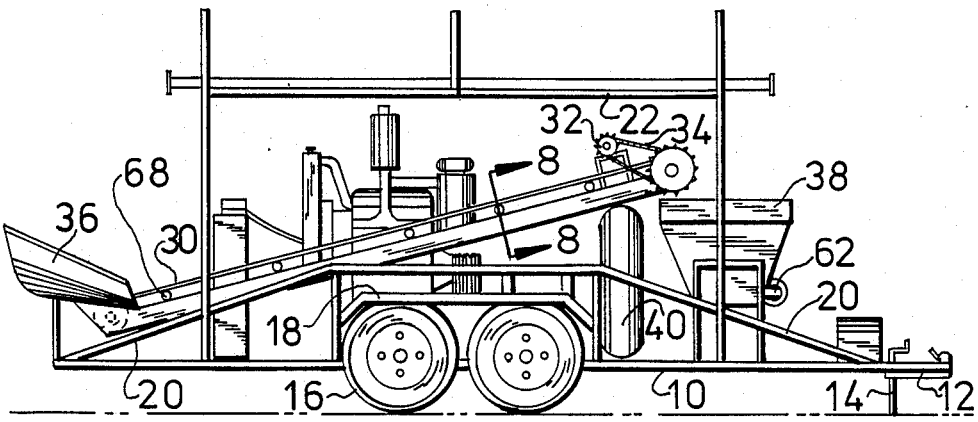
FIG. 5 is an opposite side view of the slurry mixing and pumping trailer.

FIG. 9 illustrates a manually portable, gasoline driven water pump. The pump 74 is attached to the crank case of a single cylinder engine 76 having a gas tank 78 thereabove and a pair of wheels 80 and a leg 82. A handle 84 completes the portable water pump.

Returning to FIG. 10, a typical installation for beach reclamation is illustrated. The body of water 86 is located down below a dwelling 88 and road therebehind 90. Extending down from the dwelling 88 toward the water is a landscape and lawn area 92. A beach area 94 joins the upland lawn and landscaping 92 to the water 86. A pair of the manually portable pumps as illustrated in FIG. 9 and generally denoted by 96 have been wheeled to the water's edge with suction hoses extending into the water. The outlets from the portable pumps 96 feed long flexible plastic hoses 98 which in turn lead to the slurry mixing and pumping trailer, generally denoted by 100. One of the hoses 98 is attached to the upper inlet 60 of the mixing hopper 38 and the other hose 98 is attached to the lower inlet 62 of the mixing hopper 38. Typically, each of the hoses 98 is four inches in diameter and on the order of 500 feet or more in length. The elevation of the road 90 may be on the order of 50 or more feet above the water body 86. The pumps 96 may be wheeled by one man and the hoses 98 individually carried by one man, the latter being of lightweight plastic and easily rolled up into a flat coil. Shown ghosted is a dump trailer 102 depositing the aggregate through a small door 104 onto the receiving hopper 36 of the slurry mixing and pumping trailer 100. Attached to the outlet 42 of the slurry pump 40 are lengths of plastic pipe 44 leading to the beach area 94 adjacent the water body 86. Although shown here with a U-shaped section of pipe 106, alternatively, the trailer may be reversed in position with the outlet 42 facing the body of water, thereby eliminating the need for the U-shaped section 106.

Down at the beach area, a plurality of mats 108 are positioned over the area to be reclaimed. Mats may be positioned both above the water line and under water. A very suitable and reasonably inexpensive material that is gas permeable to permit the methane and other gasses generated by decaying organic material trapped beneath the mat to pass through upwardly is a geo-textile plastic sold under the trademark "Typar" from the DuPont Corporation of Wilmington, Del. Typar is a non-woven plastic fibre mat, which not only permits gasses to pass through, but is impermeable to the sand as well as larger solids of the aggregate, and also is effective in preventing aquatic plants from growing through from the muck underneath the mat.

The lengths of pipe 44, six inches in diameter, extend to the mat 108 area, where the slurry flowing from the end of the piping can be directed over the various pieces of mat. Large pieces of mat 108 some 12 or 15 feet wide and 20 or more feet long can be easily handled manually and placed on the lake bottom or beach. The mat 108 is temporarily staked down or held down with rocks until the aggregate slurry is poured thereover. A length of 6 inch hose 110 with a nozzle is usually located at the end of the plurality of six inch pipes 44 to enable the hose operator to more easily direct the flow of slurry.

Thus, quite clearly, the apparatus enables beach reclamation to be done with a minimum of damage to the upland and a minimum of damage to surrounding areas. Either small or large areas of beach and bottom land may be reclaimed and can be reclaimed efficiently and inexpensively with the apparatus and method. Small or large beaches with a firm sand or sand and gravel bottom can be created with minimal damage to the adjacent upland and minimal damage to the bottom land adjacent thereto, which has become, in recent years, a very important consideration. Typically, there may be several hundred feet of shoreline with a muck bottom that is unsuitable for use as a beach but very suitable and important to the environment and ecology of the body of water. A small portion of this can be reclaimed economically as a beach area for the dwelling unit, leaving the bulk of the several hundred feet natural, thus minimizing the ecological damage but nevertheless providing a recreational area for the dwelling unit. The frontage areas of several homes on a body of water can be done in a single day with the apparatus and method. Thus, the cost of bringing the equipment to the site and the set up of the hoses and piping can be mutually shared.

I claim:

1. A method for environmentally benign beach reclamation adjacent a water body and sensitive upland area comprising, placing a gas permeable, solid impermeable mat on the area to be reclaimed and a manually moveable pump adjacent the water body.

pumping water from the adjacent water body with the manually moveable pump adjacent the water body through a manually portable conduit over the sensitive upland area to a remote further upland mobile mixing and pumping unit, mixing the water with a prewashed aggregate to form a water aggregate slurry, pumping the slurry from the remote mobile unit to a location above the mat and manually directing the flow of slurry to cover the mat with aggregate and return the water to the water body.

2. The method of claim 1 including pumping the water through a manually portable flexible conduit to the remote mobile unit.

3. The method of claim 1 including pumping the slurry through a manually portable flexible conduit to a manually positioned nozzle above the mat.

4. The method of claim 1 wherein aggregate is supplied to the mobile unit at a substantially constant rate to mix with the water.

5. The method of claim 1 including at least two separate manually moveable pumps supplying separate streams of water through manually portable conduits to the remote mobile mixing and pumping unit.

6. The method of claim 1 including the steps of transporting the manually moveable pump, a manually moveable mat and manually moveable conduits leading to and from the beach area over the sensitive upland area to the beach area.

7. The method of claim 1 wherein the mixing step comprises combining an aggregate of sand and pea gravel with water.

8. The method of claim 1 wherein the mixing step comprises combining an aggregate of substantially clean sand with water.

9. Environmentally benign beach reclamation apparatus comprising, a mobile platform, a mixing hopper mounted on the platform and having an outlet at the bottom thereof, a slurry pump mounted on the platform adjacent the hopper, the inlet of the slurry pump communicating with the hopper outlet, means on the platform to drive the slurry pump, manually moveable tubular means to convey slurry to a remote beach area, manually moveable pump means locatable adjacent the beach water body and manually moveable tubular means to convey water from the pump to the mixing hopper, and means to direct aggregate into the mixing hopper simultaneous with the flow of water to the hopper and removal of slurry from the hopper.

10. The beach reclamation apparatus of claim 9 including a conveyor mounted on the platform to direct the aggregate into the mixing hopper.

11. The beach reclamation apparatus of claim 10 including means to engage the drive to the slurry pump and means to drive the conveyor to the hopper.

12. The beach reclamation apparatus of claim 9 wherein the manually moveable pump means and tubular means to convey water comprise a pair of pumps and a pair of hoses and, the mixing hopper includes upper and lower inlet ports connected to the pair of hoses.

13. The beach reclamation apparatus of claim 12 wherein the lower inlet port is located opposite and directed at the hopper outlet.

14. The beach reclamation apparatus of claim 9 including means on the mobile platform to store the tubular means.

15. The beach reclamation apparatus of claim 9 including gas permeable solid impermeable mats to support aggregate on the beach.

16. Environmentally benign beach reclamation apparatus comprising, a mobile platform, a mixing hopper mounted on the platform and having an outlet at the bottom thereof, an inlet port adjacent the top of the hopper and a second inlet port located opposite and directed at the outlet port, a slurry pump mounted on the platform adjacent the hopper, the inlet of the slurry pump communicating with the hopper outlet, conveyor means on the platform to direct aggregate into the mixing hopper, means on the platform to simultaneously drive the slurry pump and the conveyor means, manually moveable tubular means to convey slurry to a remote beach area, and two manually moveable water pumps locatable adjacent the beach water body and a pair of manually moveable hoses connected to the water pumps and connected to the inlet ports of the mixing hopper.

17. The beach reclamation apparatus of claim 16 including gas permeable solid impermeable mats to support aggregate on the beach.

* * * * *